US006350211B1

(12) United States Patent
Kolmar

(10) Patent No.: US 6,350,211 B1
(45) Date of Patent: Feb. 26, 2002

(54) BASEBALL PITCHING AID

(76) Inventor: Laura Zane Kolmar, 11 Drake Rd., Mendham, NJ (US) 07945

( * ) Notice: Subject to any disclaimer, the term of this patent is extended or adjusted under 35 U.S.C. 154(b) by 0 days.

(21) Appl. No.: 09/503,094

(22) Filed: Feb. 11, 2000

Related U.S. Application Data

(60) Provisional application No. 60/120,048, filed on Feb. 12, 1999.

(51) Int. Cl.[7] ..... A63G 69/00

(52) U.S. Cl. ..... 473/454; 473/422; 473/439; 473/455; 473/198; 273/317.7; 273/317.9; 33/289

(58) Field of Search ..... 425/16, 542.2; D21/635; 273/348, 386, 390, 392, 317.7, 317.9; 473/417, 421, 422, 439, 451, 452, 454, 455; 33/1 G, 286, 293, 700, 755, 759, 1 H, 289

(56) References Cited

U.S. PATENT DOCUMENTS

| | | | | | |
|---|---|---|---|---|---|
| 884,462 | A | | 4/1908 | Bryant | |
| 2,040,228 | A | | 5/1936 | Whiteley | 273/26 |
| 2,254,986 | A | | 9/1941 | Ziel | 273/26 |
| 2,873,969 | A | | 2/1959 | Ziel | 276/26 |
| 2,890,052 | A | | 6/1959 | Burrell | 273/102.2 |
| 3,133,733 | A | | 5/1964 | Elseroad | 273/88 |
| 3,229,975 | A | | 1/1966 | Tompkins et al. | 273/26 |
| 3,633,909 | A | | 1/1972 | Doynow | 273/26 A |
| 3,658,329 | A | | 4/1972 | Ciccarello | 273/26 A |
| 3,668,781 | A | * | 6/1972 | Teter | 33/1 H |
| 3,871,647 | A | | 3/1975 | Tellez | 276/26 A |
| 3,891,221 | A | * | 6/1975 | Gordon | 473/174 |
| 4,659,090 | A | | 4/1987 | Kustanovich | 273/376 |
| 4,770,527 | A | | 9/1988 | Park | 356/28 |
| 4,781,376 | A | | 11/1988 | Barnes, Sr, | 273/26 A |
| 4,830,369 | A | | 5/1989 | Poitras | 273/26 A |
| 5,419,549 | A | | 5/1995 | Galloway et al. | 273/26 A |
| 5,566,934 | A | | 10/1996 | Black et al. | 273/26 A |
| 5,602,638 | A | | 2/1997 | Boulware | 356/28 |
| 5,820,496 | A | | 10/1998 | Bergeron | 473/455 |

* cited by examiner

*Primary Examiner*—Jeanette Chapman
*Assistant Examiner*—Mitra Aryanpour
(74) *Attorney, Agent, or Firm*—Darby & Darby

(57) ABSTRACT

A simulated image of a batter facing a pitcher is provided for use in pitching practice. The lower portion of the batter includes one or more stakes which are inserted into the ground and provide a stable support. By positioning the simulated batter in an appropriate place near "home plate", a pitcher can use the batter as a reference to determine the location of the strike zone. The size of the batter can be adjusted to vary the size of the strike zone. A ball detection apparatus and audio output can be provided to indicate when a pitch is detected and whether the pitch is a ball or a strike.

19 Claims, 7 Drawing Sheets

63
51
62
60
MIN
MAX
61

BASEBALL PITCHING AID

RELATED APPLICATION

This application claims priority from U.S. Provisional Application Ser. No. 60/120,048 entitled "Baseball Pitching Aid" and filed on Feb. 12, 1999, the entire disclosure of which is incorporated herein by reference.

FIELD OF THE INVENTION

This invention relates generally to a baseball practice apparatus. More specifically, this invention relates to a simulated batter for use as a pitching aid.

BACKGROUND OF THE INVENTION

When a person is learning how to pitch, it is common to place a target in the area designated as the "strike zone". The pitcher can then aim their throws at the target. However, the strike zone is defined by the size of the batter and it is often difficult to learn to accurately pitch a baseball without a batter standing at the plate.

Accordingly, it is an object of the invention to provide a lifelike simulated batter for use during pitching practice.

SUMMARY OF THE INVENTION

The present invention provides a figure which presents a lifelike image of a batter facing a pitcher for use in pitching practice. The lower portion of the batter includes one or more stakes which are inserted into the ground and provide a stable support. The batter is made of wood, plastic, cardboard, or other structurally suitable materials. The figure can be two-dimensional or molded to present a three-dimensional appearance. Alternatively, the batter can be made inflatable. Also, the batter may be used indoors, in which case it is provided with a stand or other similar assembly instead of or in addition to the insertion stake. For example, the insertion stake may be inserted into a stand for indoor use, or the insertion stake may be inserted into the ground in the case of outdoor use. By positioning the simulated batter in an appropriate place near "home plate", a pitcher can use the batter as a reference to determine the location of the strike zone. Preferably, the batter is formed of one or more hinged or slidably engaged pieces which are configured so that the size of the strike zone, i.e., the vertical region between the knees and the shoulder of the batter, can be adjusted. Alternatively, the pieces may be connected together by way of snaps, fittings, a friction fit, an interference fit or the like.

According to a further aspect of the invention, the simulated batter is provided with a ball detection circuit and a voice synthesizer. The detection circuit is configured to indicate when a ball or other object passes through the strike zone. In response to the detection of the ball, the voice chip is controlled to produce an appropriate audio output, for example indicating that a strike or a ball was thrown.

DETAILED DESCRIPTION OF THE PREFERRED EMBODIMENTS

Figure 1:
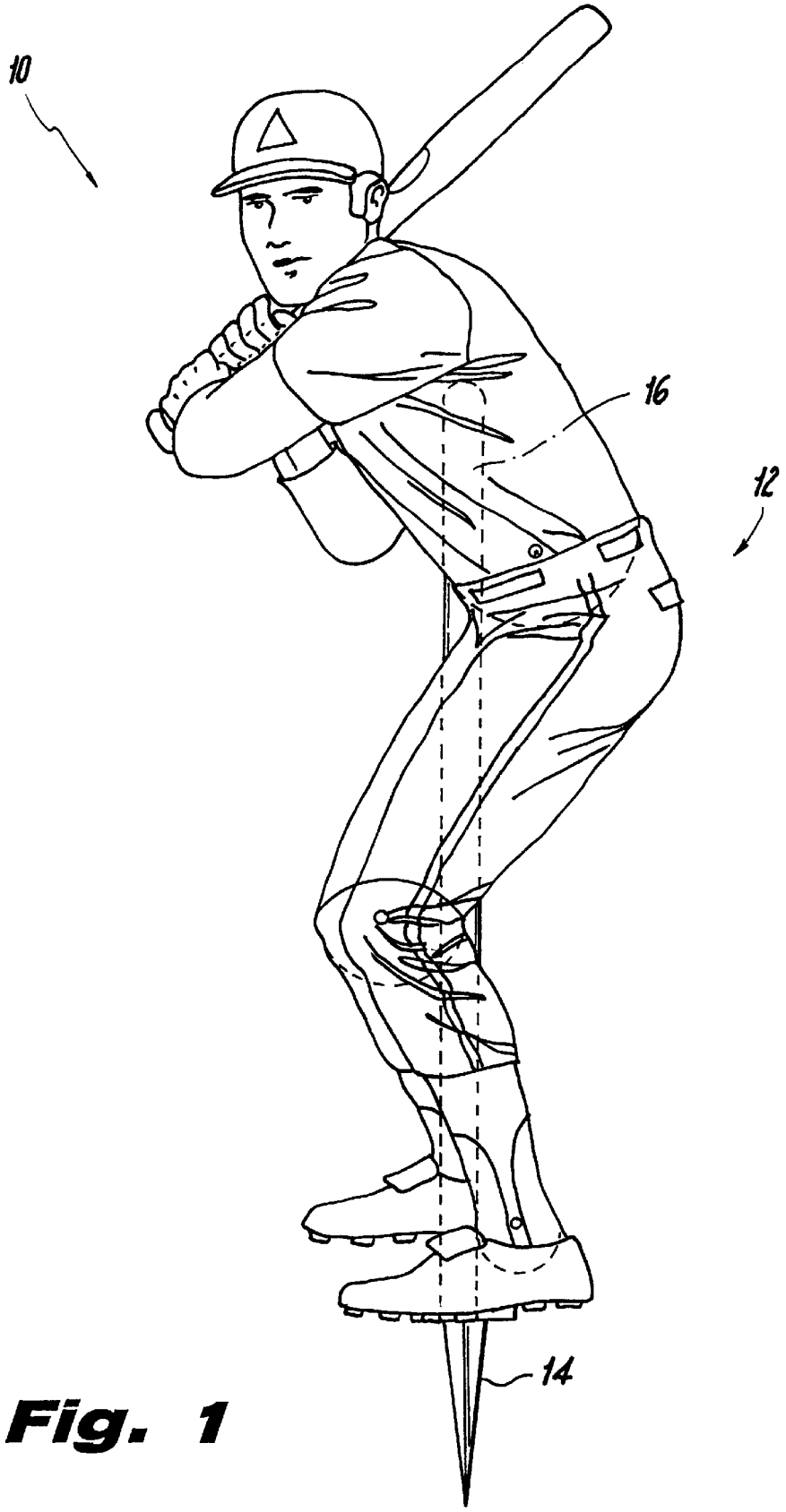
FIG. 1 is a front view of a batter figure according to a first embodiment of the invention.

Turning to FIG. 1 there is shown a first embodiment of a batter FIG. 10 according to the present invention. As shown, the batter comprises a body portion 12 with a lower stake portion 14 for positioning and retaining the body in the ground. Although one stake 14 is shown, in practice, multiple stakes can be used to improve stability.

The body portion 12 is configured to have the appearance of a figure in the "at bat" position. The body portion 12 may be configured of a flat material, such as wood, plastic, or cardboard, with the image of a batter formed thereon. Alternatively, the figure may be formed of a molded plastic shell giving a three-dimensional appearance. If necessary, a structural support (not shown), for example, a pole, is provided to retain the figure in an upright position. In the simplest form, the FIG. 10 is a unitary piece of material. However, in the preferred embodiments, the strike zone presented by the figure, i.e., the distance between the knees and the shoulder, is adjustable.

Figure 2:
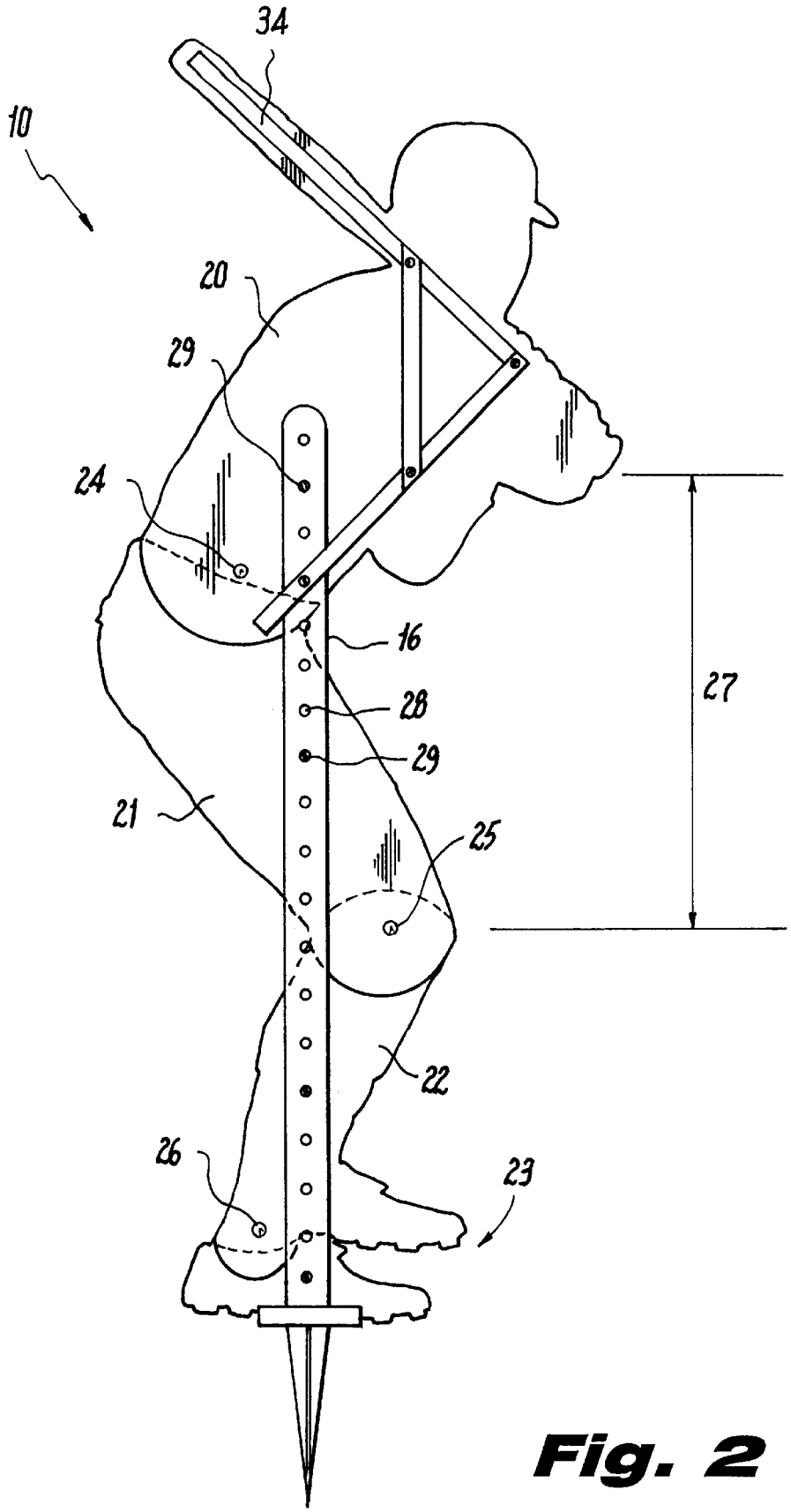
FIG. 2 is a rear view of the batter figure of FIG. 1.

FIG. 2 shows a rear view of the batter FIG. 10 of FIG. 1, further including a mechanism and configuration for adjusting the strike zone. As shown, the FIG. 10 is comprised of a plurality of articulatable parts including a torso 20, thigh, 21, calf 22 and foot 23. The parts are connected by flexible or hinged connection 24, 25 and 26 as shown. As will be apparent, the strike zone illustrated by arrow 27, can be adjusted by adjusting the angle between the respective parts 20–23. Although frictional or ratcheted hinge mechanisms can be used to maintain the FIG. 10 in the desired position, preferably, the articulatable portions 20–15 23 of the FIG. 10 are affixed to an appropriate position on support rod 16. In one embodiment, support rod 16 has a number of holes or apertures 28 which receive corresponding locking members 29. Locking members 29 can be pins or rods integrally formed on the FIG. 10, or may be screws or pegs, etc. which pass through an appropriate hole in the figure and are maintained in position by means of a clip, a bolt, friction, etc. Additional reinforced areas 34 can be provided to help maintain the structural integrity of the FIG. 10.

Figure 3:
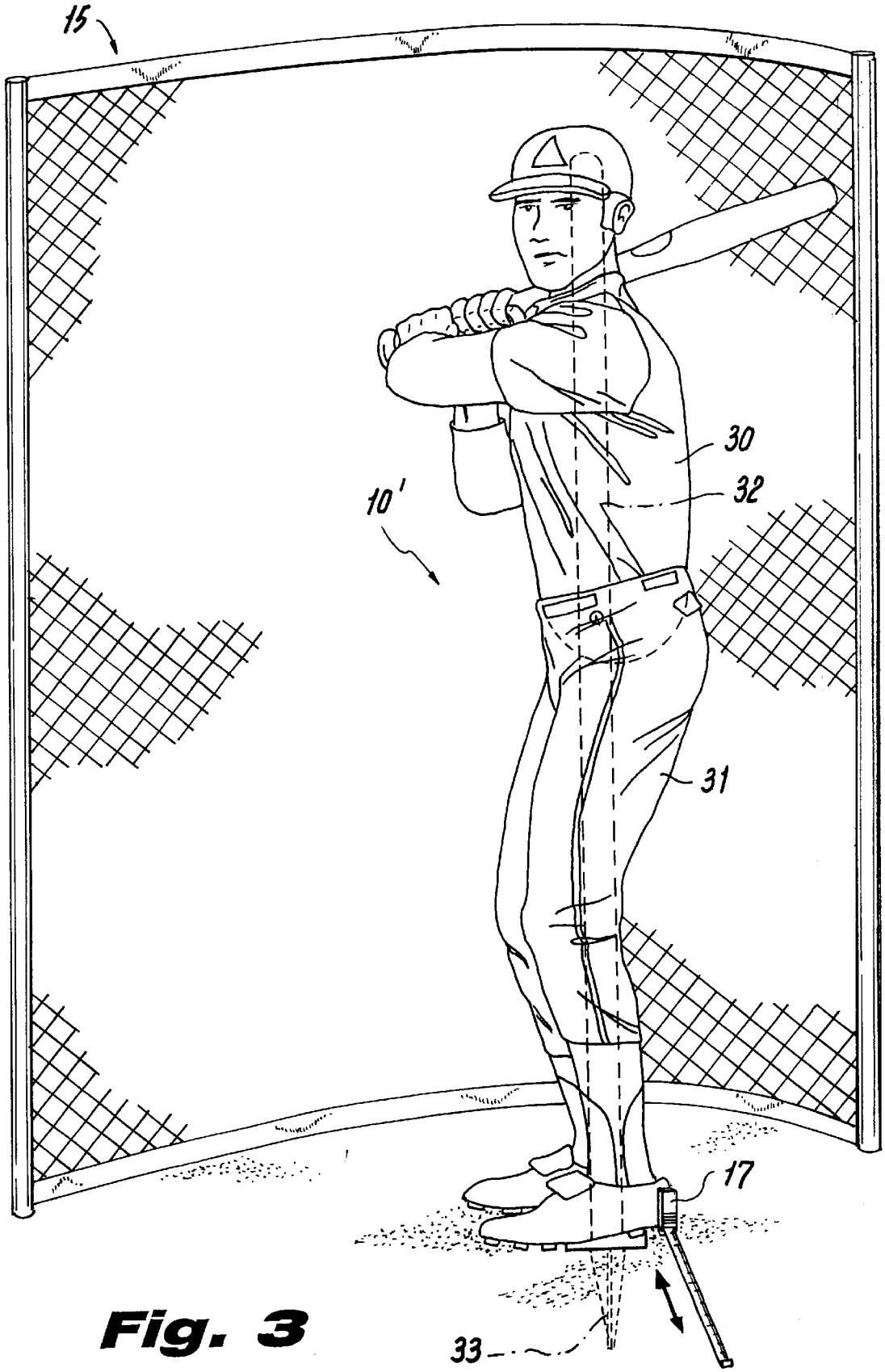
FIG. 3 is a front view of a batter figure according to a second embodiment of the invention.
Figure 4:
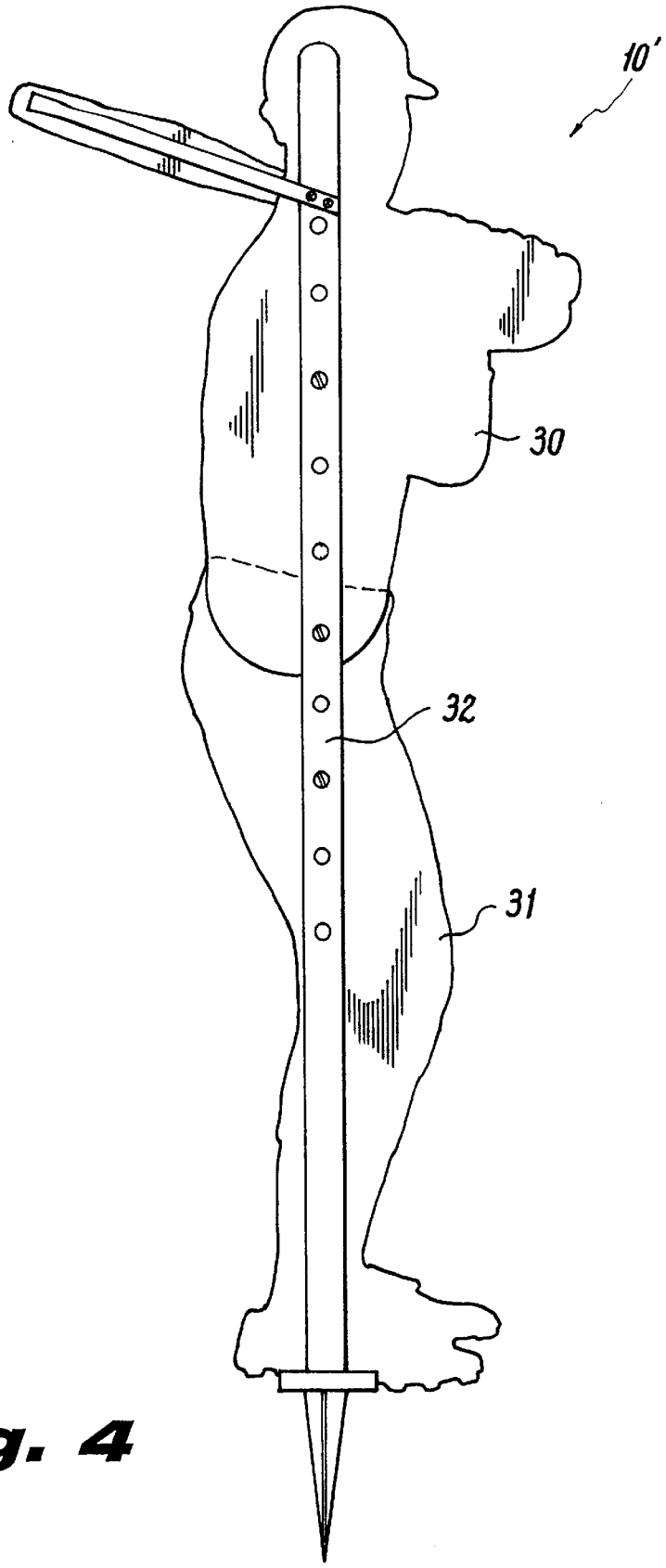
FIG. 4 is a rear view of a batter figure of FIG. 3.

A second embodiment of a figure 10' is illustrated in FIGS. 3 and 4. Similar to the first embodiment, the FIG. 10' presents a view of an at bat batter in two or three dimensions. The FIG. 10' is comprised of an upper portion 30 and a lower portion 31 and is supported by a support rod 32 that is terminated or connected to a lower stake 33. The upper portion 30 and lower portion 31 are slidably engaged so that the height of the FIG. 10' can be varied. The upper and lower portions can be maintained in the appropriate position relative to each other in a manner similar to that discussed with respect to FIG. 2 above. Alternatively, the batter figure may have a fixed height, although the fixed height may be made different for different models. For example, a short height figure may be used for little league, while a taller figure would be used for older (taller) players.

Figure 5:
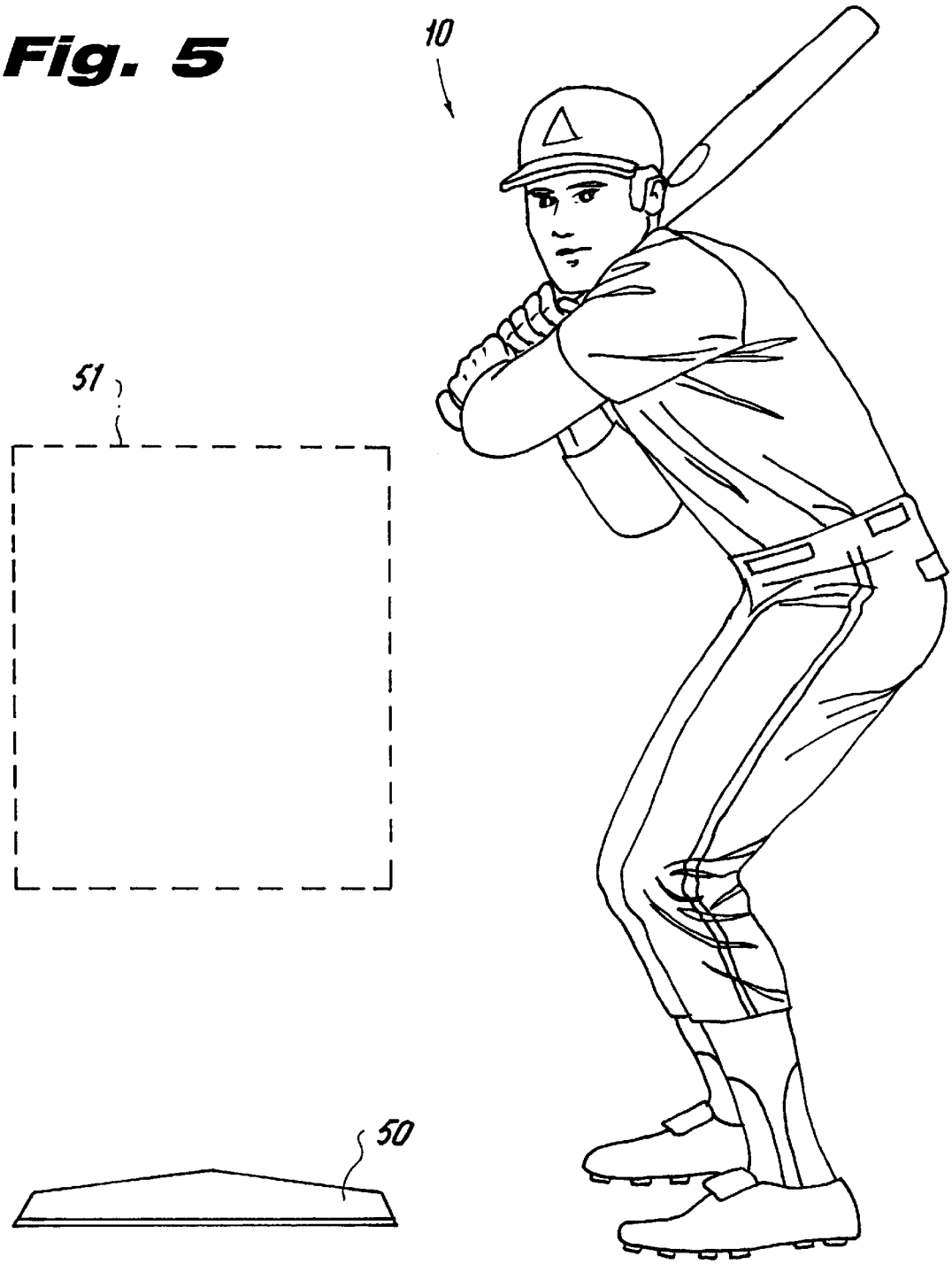
FIG. 5 illustrates a strike zone as defined by a batter figure of the invention placed next to home plate.

Turning to FIG. 5, there is shown a FIG. 10 according to the invention positioned next to a "home plate" 50. The position of the plate 50 and the knees and shoulder of the FIG. 10 define a strike zone 51. According to a further aspect of the invention, a ball detection means is included with FIG. 10 to detect when a ball thrown past the FIG. 10 passes through the strike zone. Preferably, the ball detection apparatus utilizes an ultrasonic or infrared detector and is coupled with an electronic voice synthesizer which provides appropriate audio output.

Figure 6:
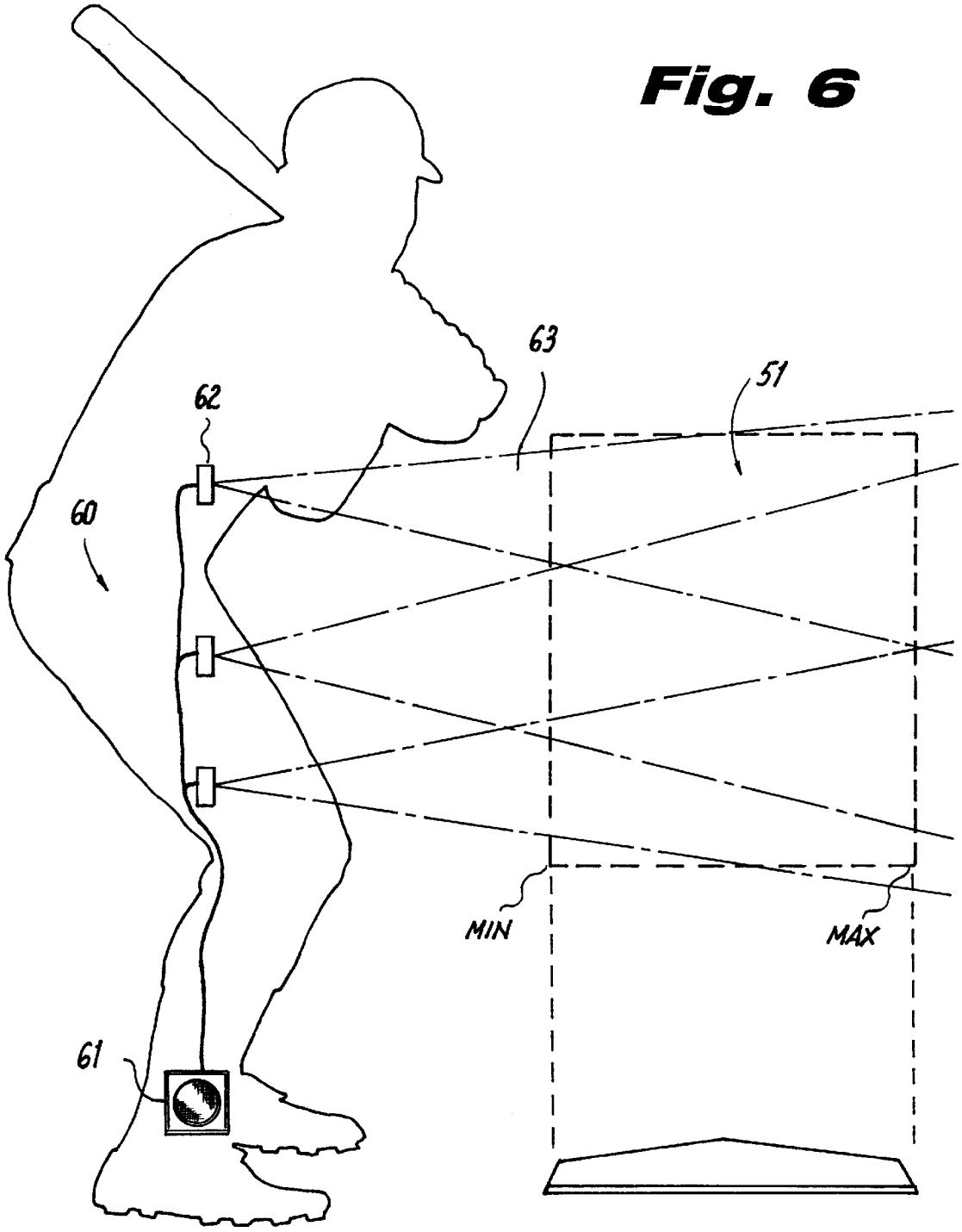
FIG. 6 illustrates a ball detection apparatus for use with the batter figure.
Figure 7:
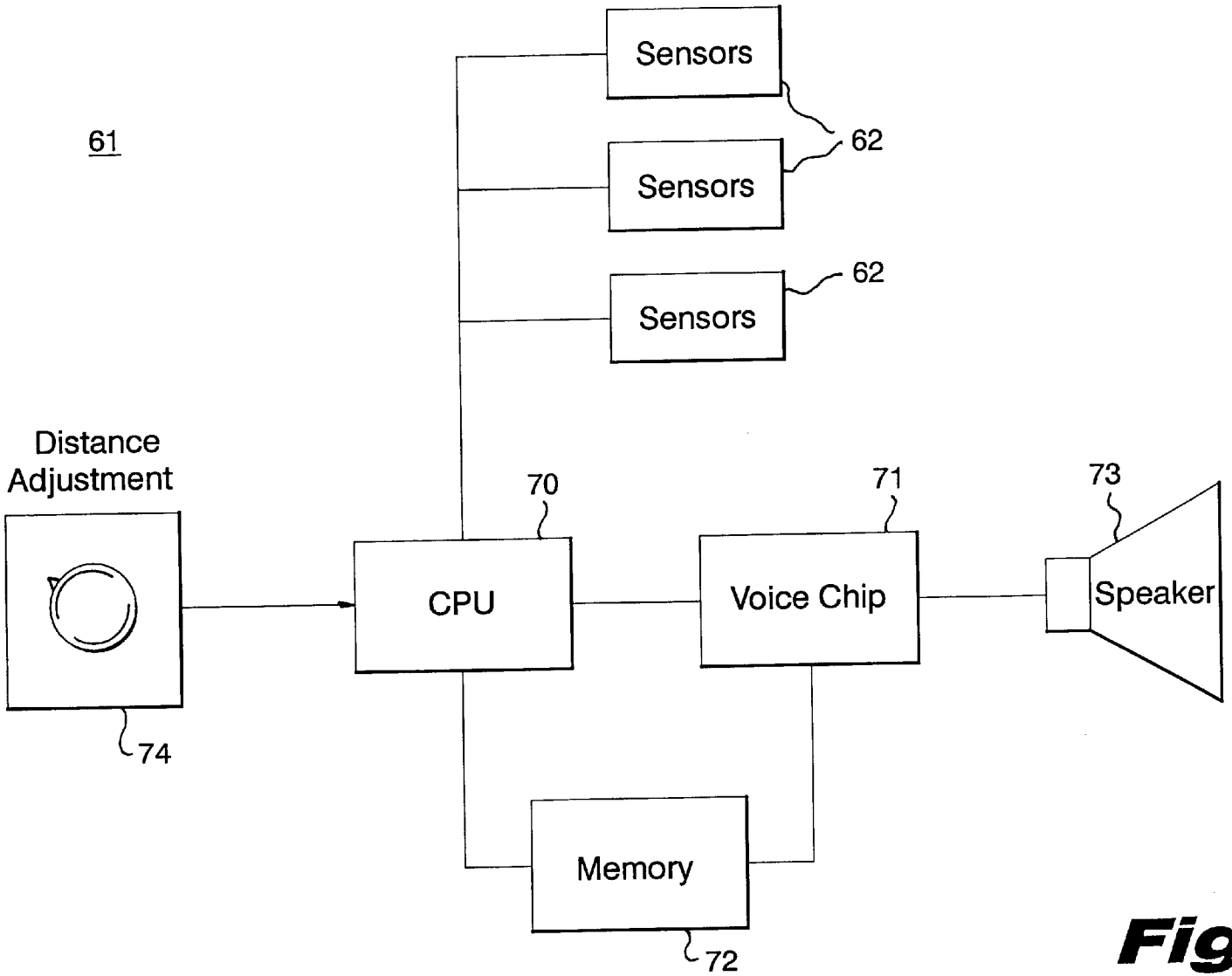
FIG. 7 is a block diagram of the ball detection circuit shown in FIG. 6.

One such ball detection apparatus is illustrated in FIGS. 6 and 7. The ball detection apparatus 60 includes a detection and output circuit 61 and one or more sensors 62. The sensors 62 are of a type which can detect the presence of an object in or near the strike zone, such as ultrasonic or infrared emitters and detectors. As shown in FIG. 7, the circuit means 61 includes a central processor 70, a voice chip 71 coupled to a memory 72 and an output speaker 73.

In one embodiment, the sensors and CPU are configured to form a range or distance sensing mechanism which can detect the presence of an object in front of the sensor and, by analyzing timing information related to emitted and detected sensor signals, determine the distance of the detected object from the sensor. If a detected distance falls between predefined minimum and maximum values, corresponding to the near and far corners of the plate 50, the central processor signals the voice chip to produce an appropriate audio output, such as "You pitched a strike!" If an object is detected outside of the minimum and maximum range, an alternative audio output can be produced, such as "You pitched a ball". Although the minimum and maximum values can be permanently stored in the memory 72, preferably a distance adjustment mechanism 74 is provided to allow the user to manually set the minimum and the maximum values so that the figure can be placed at varying positions relative to the plate and the width of the strike zone adjusted. Other ball detection circuits of various complexity can be used. For example, a simple sequence of infrared emitters and detectors can be placed on the figure, perhaps in alignment with a suitable reflector placed opposite home plate, and used to indicate when a pitch has been detected. In yet a further alternative embodiment, thin wire "whiskers" can be provided which extend into the strike zone and are jostled by a passing ball. It should be understood that the herein-described options may be selectively activated at the user's option.

The batter figure according to the present invention may be provided with a net 15 (FIG. 3) extending outward from the batter figure to catch the pitched balls.

Additionally, the batter figure according to the present invention may be provided with a distance measuring device 17 (FIG. 3), e.g., a built in tape measure, to facilitate the proper positioning and location of the batter figure.

Although the present invention has been described with respect to the preferred embodiments, various modifications can be made without departing from the spirit and the scope of the invention. In particular, although a right-handed batter is shown, the batter image may be formed on both sides of the apparatus, to allow the batter to be positioned at either the right or a left side of the plate. Preferably, in this right/left batter configuration, the support structure is removably mounted to the figure so that it may be positioned on the side of the figure opposite to the pitcher.

I claim:

1. A simulated batter for use as a pitching aid comprising:

an upper body portion;

a lower body portion;

a vertical support rod;

the lower body portion being attachable to the vertical support rod;

the upper body portion attachable to the vertical support rod at one of a plurality of positions such that at least a portion of the upper and lower body portions overlap;

the upper and lower body portions configured to produce the image of a batter in an at-bat position;

at least one sensor coupled to the one of the upper and lower body portions for detecting an object thrown past the batter;

a control circuit receiving input from the sensor and determining when a detected object has passed through a predetermined area; and an audio output responsive to the control circuit, the control circuit configured to initiate an audio output in response to the determination that the detected objected has passed through the predetermined area.

2. The batter of claim 1, further comprising a net extending outwards from the batter.

3. The batter of claim 1, further including a distance measuring device suitable for facilitating proper positioning of the batter, the distance measuring device being coupled to the batter.

4. A simulated batter for use as a pitching aid comprising:

an upper body portion and a lower body portion hingedly connected to the upper body portion, the upper and lower body portions configured to produce the image of a batter in an at-bat position;

a vertical support rod;

the lower body portion attachable to the vertical support rod at one of a plurality of positions, the position of the attachment of the upper body portion to the support rod determined a height of the batter; and a ball detection apparatus coupled to at least one of the upper and lower body portions, the ball detection apparatus having at least one sensor which detects an object thrown past the batter when the object passes through a predetermined area.

5. The batter of claim 4, further comprising a stand having the vertical support rod extending therefrom.

6. The batter of claim 4, further comprising at least one downwardly extending stake.

7. The batter of claim 4, wherein each of the body portions is substantially planar.

8. The batter of claim 4, wherein each of the body portions comprises one of wood, plastic, and cardboard.

9. The batter of claim 4, wherein each of the body portions comprises a molded plastic shell.

10. The batter of claim 4, wherein each of the upper and lower body portions is three-dimensional.

11. The batter of claim 4, wherein:

at least a section of the upper body portion is torso-shaped;

the lower body portion comprises a thigh-shaped portion hingedly connected to the upper body portion, a calf-shaped portion hingedly connected to the thigh-shaped portion, and a foot-shaped portion hingedly connected to the calf-shaped portion.

12. The batter of claim 11, wherein the thigh-shaped portion is attachable to the vertical support rod at one of a plurality of positions.

13. The batter of claim 4, wherein the ball detection apparatus further includes:

a control circuit receiving input from the sensor and determining when a detected object has passed through the predetermined area; and an audio output responsive to the control circuit, the control circuit configured to initiate an audio output in response to the determination that the detected object has passed through the predetermined area.

14. The batter of claim 4, further comprising a net extending outwards from the batter.

15. The batter of claim 4, further including a distance measuring device suitable for facilitating proper positioning of the batter, the distance measuring device being coupled to the batter.

16. The batter of claim 13, wherein the ball detection apparatus utilizes one of an ultrasonic detector and a infrared detector.

17. The batter of claim 16, wherein the at least one sensor and the control circuit are configured to form a distance sensing mechanism which detects the presence of an object in front of the at least one sensor, the ball detection apparatus determining the distance of the detected object from the at least one sensor by analyzing timing information related to emitted and detected sensor signals.

18. The batter of claim 17, wherein the predetermined area is defined in part by a minimum distance value and a maximum distance value, the predetermined area being between the minimum and maximum distance values.

19. The batter of claim 13, wherein the at least one sensor comprises a plurality of sensors disposed on a rear portion of the upper and lower body portions, each sensor emitting one of a beam and a wave such that the thrown object is detected by interfering with one of the emitted beam and emitted wave causing a signal to be sent to the control circuit.

* * * * *